United States Patent [19]

Deem

[11] Patent Number: 4,894,028

[45] Date of Patent: Jan. 16, 1990

[54] SELF-EXPANDABLE BATTERY TERMINAL CLAMP

[76] Inventor: James R. Deem, 1855 Belmont St., Boise, Id. 83706

[21] Appl. No.: 180,396

[22] Filed: Apr. 12, 1988

[51] Int. Cl.[4] ..... H01R 4/42

[52] U.S. Cl. ..... 439/762; 439/765

[58] Field of Search ..... 439/760–763, 439/765, 770

[56] References Cited

U.S. PATENT DOCUMENTS

| | | | |
|---|---|---|---|
| 1,858,288 | 5/1932 | Terrell et al. | 439/762 |
| 1,920,548 | 8/1933 | Carlson | 439/762 |
| 2,009,403 | 7/1935 | Koops | 439/762 |
| 4,740,179 | 4/1988 | Padget | 439/765 |

*Primary Examiner*—P. Austin Bradley

*Attorney, Agent, or Firm*—Leslie G. Murray

[57] ABSTRACT

A C-shaped clamp having elongated flanges at its ends defining the open portion of the "C". A bolt is inserted through holes provided in the flanges. A nut tightened on the bolt against one of the flanges compresses the C-shaped clamp. A U-shaped key slideably fitted in a lengthwise slot in the threaded end of the bolt engages the inside wall of one flange and the outwardly facing side of the nut and pulls the flanges apart when the nut is loosened on the bolt thus expanding the C-shaped clamp.

14 Claims, 3 Drawing Sheets

SELF-EXPANDABLE BATTERY TERMINAL CLAMP

BACKGROUND OF THE INVENTION

The present invention relates generally to electrical cable connector clamps and, more particularly, to self-expandable connector clamps utilized with lead storage batteries.

It is well known in the art to utilize ring or C-shaped electrically conductive clamps to connect high current capacity cables to the terminals of electrical storage batteries and the like. The prior art clamp is typically a C-shaped clamp utilizing a bolt and nut assembly to compress the clamp around the battery terminal thus retaining the clamp securely in place on the battery terminal. To remove the clamp from around the battery terminal the nut is loosened thus allowing the C-clamp to be expanded and removed. Since the clamp is typically fabricated from a relatively soft, plastic or pliable material that retains its shape, it is necessary to manually expand the clamp after the nut has been loosened, prying open the C-clamp with the blade of a screw driver, for example, or using a special tool or wrench.

Accordingly, it is a primary object of the present invention to provide a battery terminal clamp which is self-expanding and thus removable when the securing nut has been loosened without further manipulation of the clamp or its component parts.

It is another object of the present invention to provide a self-expandable battery terminal clamp which is simple and inexpensive in construction.

SUMMARY OF THE INVENTION

In accordance with the principles of the present invention, a self-expandable battery terminal clamp comprises a C-shaped clamp having slightly extended, flattened end portions which define the open portion of the C-shaped clamp with a bolt inserted through holes provided in the end portions and a nut which compresses the clamp when it is tightened on the bolt. The threaded portion of the bolt is slotted to receive an elongated U-shaped key such that when the U-shaped key is installed, the nut is coupled to one flattened end portion of the C-shaped clamp. As the nut is loosened on the bolt, the flattened end portion of the clamp will be pulled outwardly by the nut thus expanding the clamp and allowing it to be removed from a battery terminal.

Other objects and features and a more clear understanding of the present invention will become apparent from the detailed description taken in conjunction with the accompanying drawings, in which like reference numbers refer to like parts as illustrated in the different figures.

DETAILED DESCRIPTION OF THE PREFERRED EMBODIMENT

Figure 1:
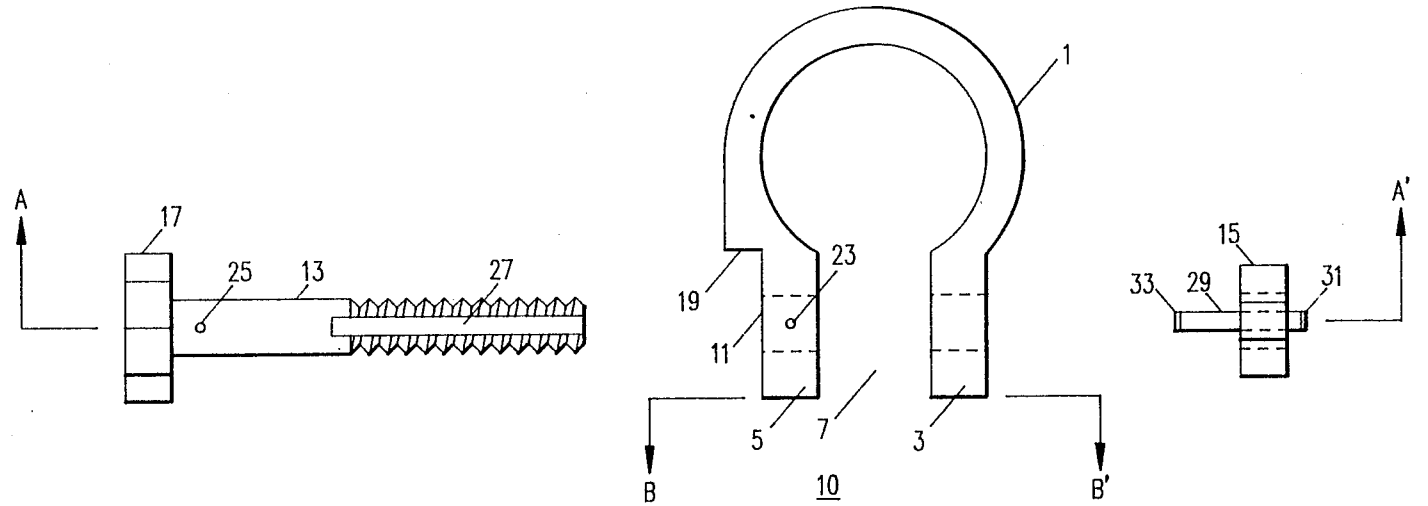
FIG. 1 is a top plan view of a battery terminal clamp according to the principles of the present invention.
Figure 2A:
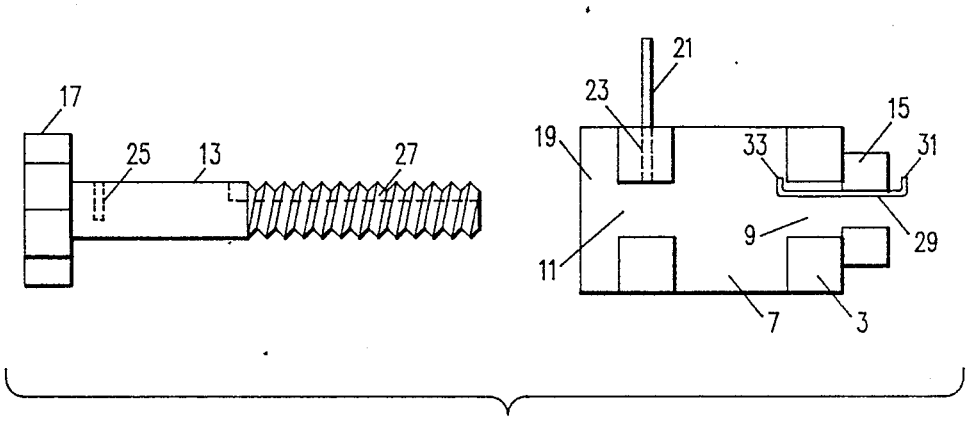
FIG. 2*a* is a sectional view taken along line A–A′ of the battery terminal clamp shown in FIG. 1.
Figure 2B:
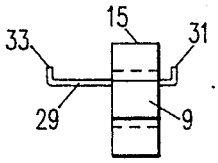
FIG. 2*b* is a sectional view taken along line A–A′ of the nut and U-shaped key shown in FIG. 1.

Referring now to FIGS. 1, 2*a* and 2*b*, a self-expandable battery cable clamp 10 constructed in accordance with the principles of the present invention is shown. A C-shaped clamp 1 having elongated or extended and flattened end portions or flanges 3 and 5 which define the open portion 7 of the C-shape is formed from lead or other suitable, electrically conductive material. The material should be relatively soft and pliable or easily deformed when used for electrical applications such a battery cable clamp 10. The clamp 10, when fabricated from a material having sufficient tensile strength may also be used to connect cables or rods to posts or pilings and the like. A hole 9, 11 through each of the flattened end portions 3 and 5, respectively, is provided to receive a threaded bolt 13. When bolt 13 is inserted through holes 9 and 11, a nut 15 having matching threads engages and is tightened on bolt 13 against flattened end 3 thereby compressing the C-shaped clamp 1. As the nut 15 is tightened or loosened on bolt 13, the bolt head 17 engages flat shoulder 19 formed in the end portion 5 and is prevented from rotating. Alternatively, pin 21 may be inserted through bore 23 provided in end portion 5 and into bore 25 formed in the shaft of bolt 13 thereby preventing rotation of bolt 13 when nut 15 is tightened or loosened on bolt 13. The pin 21 is also used to retain bolt 13 in place when the nut 15 is loose or has been removed.

The bolt 13 has a slot 27 formed in the threaded portion of its shaft which extends lengthwise from the end of the bolt 13 to the end of the threaded portion and into the shank portion of the bolt 13. The length of slot 27 must be such that when bolt 13 is inserted through holes 9 and 11 and the nut 15 has been tightened on bolt 13 compressing the C-shaped clamp 1, the slot 27 extends into the open portion 7 between the end portions 3 and 5 of the clamp 1. The width and depth of slot 27 must be such that an elongated, U-shaped key 29 will fit snugly in the slot 27 yet freely slide lengthwise in the slot 27. U-shaped key 29 is formed from metal, such as spring steel, or other suitable material which has a much greater tensile strength than the material that the C-shaped clamp 1 is made from.

Figure 2C:
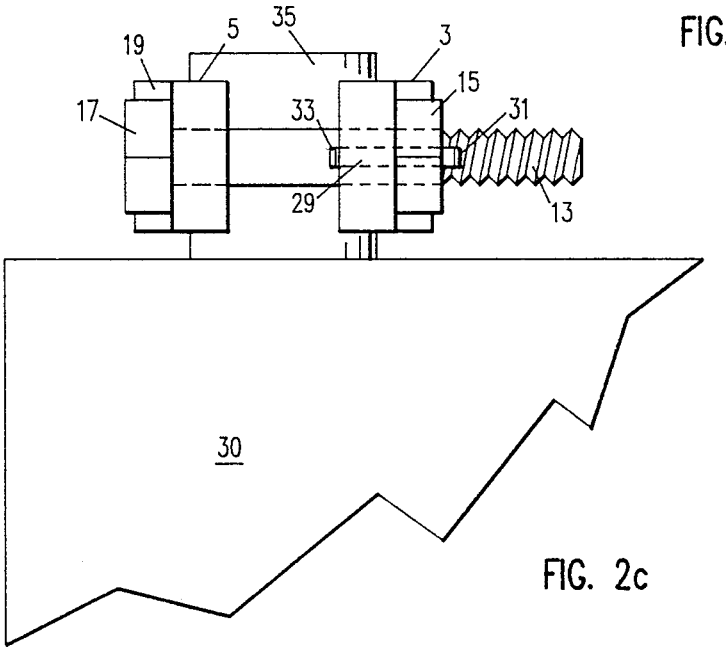
FIG. 2*c* is a sectional view taken along line B–B′ of the battery terminal clamp shown in FIG. 1 illustrating the clamp installed on a battery post.

To assemble the battery terminal clamp 10, the nut 15 is positioned adjacent the outside surface of flattened end portion 3, aligned with hole 9. U-shaped key 29 is inserted lengthwise through the nut 15 and hole 9 such that the legs 33, 31 of the "U" extend radially outwardly from the centerline of the hole 9 and the bore of the nut 15, respectively. One leg 31 is on the outside of the C-shaped clamp adjacent the outwardly facing side of the nut 15 and the other leg 33 is in the open portion 7 of the C-shaped clamp adjacent the inwardly facing side of end portion 3. The bolt 13 is then inserted through hole 11 in end portion 5 of the C-shaped clamp 1 and rotated to align the slot 27 with the key 29. The bolt 13 is then inserted through hole 9 in end portion 3, the key 29 slidingly engaging slot 27. The bolt 13 is further rotated to align a flat portion of bolt head 17 with shoulder 19 or to align bore 25 in the bolt 13 shank with bore 23 in end portion 5 and engaged with nut 15. The nut 15 is then tightened on bolt 13 drawing bolt 13 fully through the end portions 3 and 5 and bolt head 17 into engagement with shoulder 19 or allowing pin 21 to be inserted through bore 23 into bore 25 and thus prevent rotation of bolt 13 as the nut 15 is further tightened or loosened on bolt 13. Further tightening of the nut 15 on bolt 13 will urge nut 15 against the outside wall of flattened end portion 3 compressing the C-shaped clamp 1. Loosening of the nut 15 on bolt 13 urges nut 15 against leg 31 of U-shaped key 29 sliding key 29 in slot 27 and bringing leg 33 of key 29 into contact with the inside wall of flattened end portion 3. Further loosening of the nut 15 on bolt 13 urges the end portion 3 outwardly thereby expanding the C-shaped clamp 1. Preferably, the U-shaped key 29 is oriented in the plane of the C-shaped clamp 1 such that the legs 31, 33 engage the end of the elongated end portion 3 thereby requiring less force to expand the C-shaped clamp 1 as shown in FIG. 2*c*.

Figure 3:
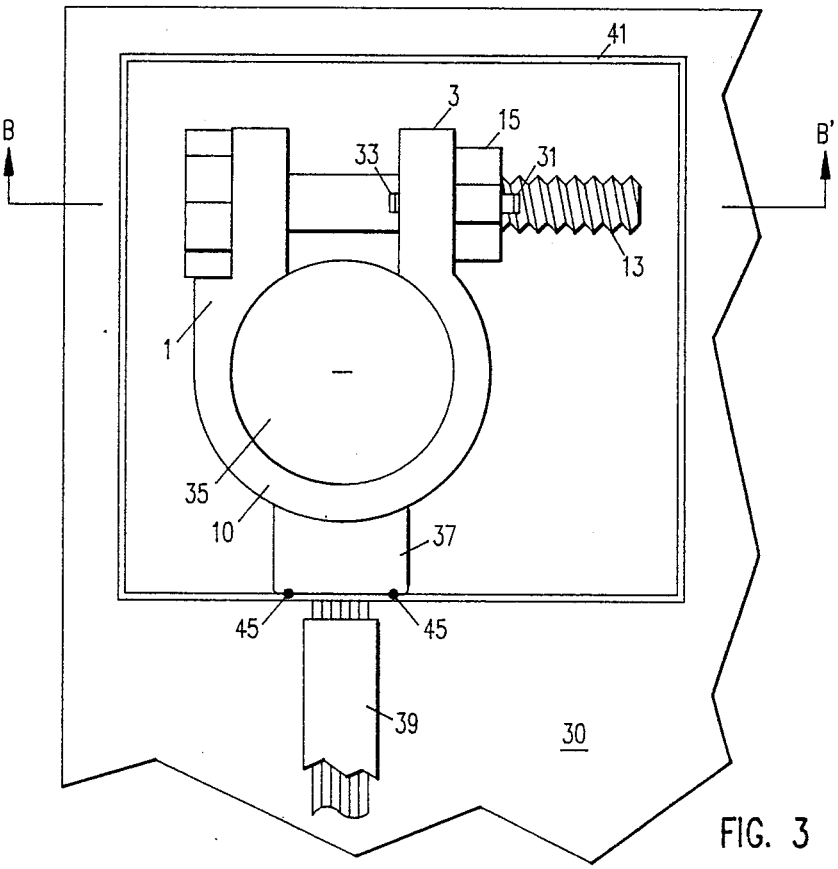
FIG. 3 is a top plan view of a battery illustrating the battery terminal clamp of FIG. 1 installed.
Figure 4:
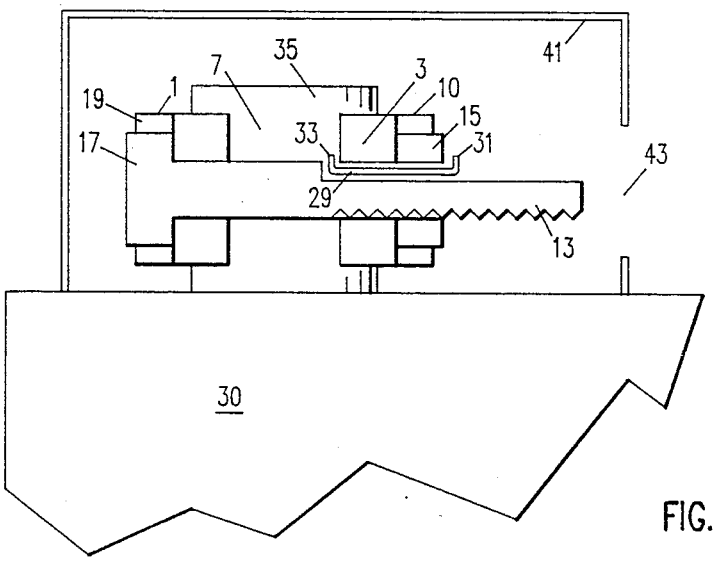
FIG. 4 is a sectional view taken along line B–B′ of the battery and battery terminal clamp shown in FIG. 3.

Referring now also to FIGS. 3 and 4, a partial view of a storage battery 30 with the self-expandable battery terminal clamp 10 installed on a battery terminal or post 35 is shown. Nut 15 is shown tightened against flattened end portion 3 with the C-shaped clamp 1 compressed tightly around battery post 35 and held securely in position and providing electrical connection between the battery 30 and the cable 39 attached to battery terminal clamp 10. U-shaped key 29 is shown in its installed position in slot 27 with one leg 33 projecting into the clamp open portion 7 adjacent the inside wall of end portion 3 and the other leg 31 adjacent the outwardly facing side of the nut 15. The bolt head 17 is engaged with shoulder 19 to prevent rotation of the bolt 13 whenever the nut 15 is loosened or tightened on bolt 13. Connector 37 is a metal coupling means either molded with or otherwise physically and electrically attached to C-shaped clamp 1 to facilitate connecting battery cable 39 to the battery terminal clamp 10.

Another feature of the preferred embodiment is shield 41 which surrounds and encloses battery post 35 and battery terminal clamp 10 to prevent personal injury due to sparking or arcing when the battery terminal clamp 10 is installed on or removed from battery post 35 or resulting from personal contact with any battery acid residue which may be present at the battery post 35. Shield 41 is preferably attached to battery terminal clamp 10 at points 45 as an integral part, but may be installed on the battery 30 separately. Opening 43 in the shield 41 sidewall adjacent the nut 15 is provided to allow the use of a socket or wrench (not shown) to tighten or loosen the nut 15 to allow installation or removal of the battery terminal clamp 10. The shield 41 may be fabricated from sheet metal or plastic or other suitable material.

Although the present invention has been described in its preferred form with a certain degree of particularity, it is understood that the present disclosure of the preferred embodiment has been by way of example and that numerous changes in the details of construction and the combination and arrangements of elements may be resorted to without departing from the spirit and scope of the invention as hereinafter claimed.

I claim:

1. A self-expandable clamp comprising:

a generally C-shaped partial ring structure having first and second end portions defining an opening, said first and second end portions each having an elongated and flattened portion, said elongated and flattened portion extending radially outwardly from said C-shaped partial ring structure defining said opening;

a nut and bolt assembly, said flattened and elongated portion of said first of said first and second end portions each having a hole therethrough for receiving said bolt, said nut engaging said bolt when said bolt is inserted through said holes, said first and second end portions being urged together when said nut is tightened on said bolt thereby compressing said partial ring structure; and means coupling said nut and bolt assembly to at least one of said first and second end portions, said means responsive to said nut being untightened on said bolt to urge said first and second end portions apart thereby expanding said partial rin structure.

2. A self-expandable cable clamp as in claim 1 wherein said means comprises an elongated U-shaped key, said U-shaped key coupling said nut to said first end portion, said U-shaped key responsive to said nut being loosened on said bolt to urge said first and second end portions apart thereby expanding said C-shaped partial ring structure.

3. A self-expandable clamp as in claim 2 wherein said bolt has a threaded end portion for engaging said nut, said bolt including a slot defined lengthwise therein extending from said threaded end and extending into said opening when said bolt is inserted through said holes and said C-shaped partial ring is compressed, said U-shaped key slideably disposed in said slot when said bolt is inserted through said holes, said nut engaging said U-shaped key when said nut is loosened on said bolt urging said first and second end portions apart.

4. A self-expandable clamp as in claim 2 further including locking means engaging said bolt when said bolt is inserted through said holes preventing said bolt from rotating when said nut is tightened or loosened on said bolt and retaining said bolt in said holes.

5. A self-expandable clamp as in claim 4 wherein said locking means comprises a shoulder formed on the radially outwardly facing side of said C-shaped partial ring adjacent said second end portion, said bolt engaging said shoulder when said bolt is inserted through said holes, said shoulder preventing rotation of said bolt when said nut is tightened or loosened on said bolt.

6. A self-expandable clamp as in claim 4 wherein said locking means comprises a first aperture through and normal to the wall of said hole through said elongated flattened portion, of said second end portion, said bolt including a second aperture crosswise partially therethrough, said first and second apertures aligned when said bolt is inserted through said holes, said first and second apertures for receiving a pin, said pin preventing rotation of said bolt when said pin is inserted through said apertures.

7. A self-expandable battery terminal clamp comprising:

a C-shaped clamp fabricated of an electrically conducting material, said C-shaped clamp including first and second end portions defining an opening between said first and second end portions, said first and second end portions each having elongated and flattened flanges;

a bolt and nut assembly, said bolt having a head and a threaded end engaging matching threads in the bore of said nut, said first and second end portion flanges each having a hole therethrough for receiving said bolt, said bolt being inserted through said holes and engaging said nut, said nut urging said first and second end portion flanges towards each other when said nut is tightened on said bolt against said first end portion flange thereby compressing said C-shaped clamp; and coupling means coupling said nut to said first end portion flange, said coupling means responsive to said nut being loosened on said bolt to urge said first and second end portion flanges apart thereby expanding said C-shaped clamp.

8. A self-expandable battery terminal clamp as in claim 7 further including locking means preventing said bolt from rotating when said nut is tightened or loosened on said bolt.

9. A self-expandable battery terminal clamp as in claim 8 wherein said locking means comprises a shoulder formed on the radially outwardly facing side of said C-shaped clamp adjacent said second end portion, said bolt head engaging said shoulder when said bolt is inserted through said holes, said shoulder preventing rotation of said bolt.

10. A self-expandable battery terminal clamp as in claim 8 wherein said locking means comprises a first aperture through and normal to the wall of said hole through said second end portion flange, said bolt including a second aperture formed crosswise partially therethrough, said first and second apertures aligned when said bolt is inserted through said holes, said first and second apertures for receiving a pin preventing rotation of said bolt and retaining said bolt in position in said holes when said pin is inserted through said first aperture into said second aperture.

11. A self-expandable battery terminal clamp as in claim 8 wherein said coupling means comprises an elongated U-shaped key, said key coupling said nut to said first end portion flange, said U-shaped key responsive to said nut being loosened on said bolt to urge said first and second end portions apart thereby expanding said C-shaped clamp.

12. A self-expandable battery terminal clamp as in claim 11 wherein said bolt includes a slot defined lengthwise therein extending from said threaded end, said slot extending into said opening when said bolt is inserted through said holes and said C-shaped clamp is compressed, said U-shaped key slideably disposed in said slot when said bolt is inserted through said holes, said nut engaging said U-shaped key when said nut is loosened on said bolt urging said first and second end portions apart.

13. A self-expandable battery terminal clamp as in claim 12 further comprising shield means surrounding said battery terminal clamp.

14. A self-expandable battery terminal clamp as in claim 13 wherein said shield means comprises an enclosure attached to said battery terminal clamps and enclosing said battery terminal clamp when said battery terminal clamp is installed on a battery post, said enclosure having an opening in a side wall adjacent said nut to facilitate tightening or loosening said nut on said bolt.

* * * * *